US009572381B2

(12) United States Patent
Maryea

(10) Patent No.: US 9,572,381 B2
(45) Date of Patent: Feb. 21, 2017

(54) CONVERTIBLE SHORTS/SKIRT/LEGGINGS

(71) Applicant: Denise Maryea, Largo, FL (US)

(72) Inventor: Denise Maryea, Largo, FL (US)

( * ) Notice: Subject to any disclaimer, the term of this patent is extended or adjusted under 35 U.S.C. 154(b) by 0 days.

(21) Appl. No.: 14/618,156

(22) Filed: Feb. 10, 2015

(65) Prior Publication Data

US 2015/0237935 A1 Aug. 27, 2015

Related U.S. Application Data

(60) Provisional application No. 61/942,747, filed on Feb. 21, 2014.

(51) Int. Cl.

| | |
|---|---|
| ***A41D 15/00*** | (2006.01) |
| ***A41D 17/02*** | (2006.01) |
| ***A41D 1/14*** | (2006.01) |
| ***A41D 1/06*** | (2006.01) |

(52) U.S. Cl.

CPC ..... *A41D 15/00* (2013.01); *A41D 1/06* (2013.01); *A41D 1/14* (2013.01); *A41D 17/02* (2013.01)

(58) Field of Classification Search

CPC ..... A41D 15/00; A41D 15/02; A41D 1/06; A41D 1/08; A41D 17/02; A41D 1/14; A41B 11/12; A41B 11/14; A41B 9/08

USPC ..... 2/209, 19, 71

See application file for complete search history.

(56) References Cited

U.S. PATENT DOCUMENTS

| | | | | | |
|---|---|---|---|---|---|
| 259,877 | A * | 6/1882 | Lightcapp | A41B 9/04 | 2/407 |
| 269,479 | A * | 12/1882 | McCormick et al. | A41D 1/06 | 2/227 |
| 520,225 | A * | 5/1894 | Sittig | A41D 27/12 | 2/212 |
| 1,159,439 | A * | 11/1915 | Walker | A41D 15/00 | 2/70 |
| 1,172,615 | A * | 2/1916 | Lelansky | A41D 15/00 | 2/70 |
| 1,398,720 | A * | 11/1921 | Hershey | A41D 15/02 | 2/212 |
| 1,422,441 | A * | 7/1922 | Harmon | A41D 15/02 | 2/213 |
| 1,470,849 | A * | 10/1923 | Klappert | A41D 15/02 | 2/72 |
| 1,537,845 | A * | 5/1925 | McElwee | A41D 17/02 | 2/82 |
| 1,652,750 | A * | 12/1927 | Wohlgemuth | A41D 13/0002 | 2/210 |

(Continued)

*Primary Examiner* — Anna Kinsaul
*Assistant Examiner* — Jocelyn Wu

(57) ABSTRACT

A clothing system has removable leggings that have two legging portions. Each legging portion has an ankle end and a distal end; the distal end has at least one attachment mechanism and a seam of the distal end has elastic material there within. A shorts portion has a waistband and at least one mating attachment mechanism. A skirt portion is affixed to the shorts portion at the waistband. When worn, each of the legging portions is connected to the shorts portion by the attachment mechanisms and respective mating attachment mechanisms in the shorts portion and the shorts portion substantially covers and hides the distal end of each of the legging portions. When the skirt portion is deployed, the skirt portion substantially covers the shorts portion and, when the skirt portion is not deployed, the skirt portion is worn over the waistband to provide the appearance of a belt.

1 Claim, 10 Drawing Sheets

(56) References Cited

U.S. PATENT DOCUMENTS 1,691,790 A * 11/1928 Volker ..... A41B 9/08 2/71
1,924,433 A * 8/1933 Harpster ..... A41B 11/12 2/240
2,062,596 A * 12/1936 Monette ..... A41B 9/08 2/408
2,081,532 A * 5/1937 Fisch ..... A41D 11/00 2/227
2,138,230 A * 11/1938 Friedman ..... A41D 15/02 2/212
2,216,852 A * 10/1940 McMeekin ..... A41D 1/06 2/227
2,279,125 A * 4/1942 Mintzes ..... A41D 15/00 2/79
2,308,929 A * 1/1943 Mintzes ..... A41D 15/00 2/71
2,364,636 A * 12/1944 Lang ..... A41B 11/12 2/240
2,483,136 A * 9/1949 Hamman ..... A41D 3/06 2/82
2,526,978 A * 10/1950 Sullivan ..... A41B 9/08 2/212
2,599,769 A * 6/1952 Macrae ..... A41D 1/08 2/228
2,659,893 A * 11/1953 Hindman ..... A41B 9/08 2/212
2,703,404 A * 3/1955 Lawson ..... A41D 1/06 2/227
2,728,998 A * 1/1956 Queen ..... A41D 17/02 36/2 R
2,827,638 A * 3/1958 Scharf ..... A41D 1/14 2/212
2,835,897 A * 5/1958 Scruggs ..... A41D 13/1236 2/71
3,002,193 A * 10/1961 Briskman ..... A41D 1/00 2/72
3,052,994 A * 9/1962 Johnston ..... A41D 17/02 36/2 R
3,128,475 A * 4/1964 Rice ..... A41B 11/14 2/227
3,147,491 A * 9/1964 Fisch ..... A41D 3/06 2/86
3,266,057 A * 8/1966 Phelps ..... A41D 1/06 2/227
3,287,739 A * 11/1966 Kaplan ..... A41B 11/14 2/227
3,463,162 A * 8/1969 Heggie ..... A41B 11/12 2/240
3,678,514 A * 7/1972 Safrit ..... A41B 9/08 2/212
3,678,515 A * 7/1972 Wehrmann ..... D04B 1/243 2/409
3,961,376 A * 6/1976 Howell ..... A41D 15/00 2/71
4,091,466 A * 5/1978 Kearn ..... A41D 13/015 2/227
4,100,624 A * 7/1978 Davis ..... D05B 23/008 2/409
4,106,125 A * 8/1978 Palumbo ..... A41D 15/02 2/213
4,190,908 A * 3/1980 Herskind ..... A41D 1/06 2/213
4,215,435 A * 8/1980 Miele ..... A41D 15/002 2/227
4,390,996 A * 7/1983 Read ..... A41D 15/00 2/70
4,390,999 A * 7/1983 Lawson ..... A41B 11/14 2/409
4,424,596 A * 1/1984 Jackson ..... A61F 13/08 2/240
4,633,527 A 1/1987 Ehring
4,656,669 A * 4/1987 Beard ..... A41D 7/00 2/67
4,766,613 A * 8/1988 Wells ..... A41D 15/002 2/227
4,811,427 A * 3/1989 Regan ..... A63B 71/12 2/227
4,903,345 A * 2/1990 Oakley ..... A41B 11/14 2/240
5,052,058 A * 10/1991 Mueller ..... A41B 9/001 2/227
5,097,537 A * 3/1992 Ewing ..... A41B 11/003 2/239
5,123,120 A * 6/1992 Ross ..... A41D 13/02 2/229
5,136,727 A * 8/1992 Brisco ..... A41D 1/08 2/228
5,182,812 A * 2/1993 Goldsby ..... A61H 36/00 2/227
5,345,613 A * 9/1994 Jones ..... A41B 11/00 2/240
5,539,927 A * 7/1996 Holubec ..... A41D 1/08 2/227
5,598,586 A * 2/1997 Munjone ..... A41D 1/08 2/228
5,608,915 A * 3/1997 Libit ..... A41D 1/06 2/228
5,675,842 A * 10/1997 Schaefer ..... A41F 9/02 2/221
5,708,987 A * 1/1998 Matthews ..... A41B 11/14 2/242
5,774,892 A * 7/1998 Tisdale ..... A41D 1/06 2/115
5,864,888 A * 2/1999 Archer ..... A41D 1/082 2/227
5,870,775 A * 2/1999 Noyola ..... A41D 15/00 2/227
5,876,394 A * 3/1999 Rosch ..... A41D 7/005 604/367
5,926,856 A * 7/1999 Duval ..... A41D 13/0153 2/22
5,943,699 A * 8/1999 Barbeau ..... A41D 1/067 2/227
6,009,558 A * 1/2000 Rosch ..... A41D 7/00 2/212
6,047,404 A * 4/2000 Blanks, I ..... A41D 15/00 2/108
6,101,635 A * 8/2000 Jones ..... A41B 11/12 2/239
6,158,056 A * 12/2000 Riley ..... A41D 15/002 2/269
6,308,338 B1 * 10/2001 Caldwell ..... A41D 1/062 2/312
D452,988 S * 1/2002 Ergezinger ..... A41D 15/00 D2/743
6,360,371 B1 * 3/2002 Davey ..... A41D 15/00 2/466
6,393,622 B1 * 5/2002 Rice ..... A41F 11/00 2/406
6,430,753 B2 * 8/2002 Duran ..... A41B 11/00 2/239
6,978,484 B2 * 12/2005 Donlan ..... A41D 1/06 2/227
7,389,547 B1 * 6/2008 Wiens ..... A41D 1/08 2/227
7,937,767 B2 * 5/2011 Leach ..... A41B 11/12 2/22
D644,412 S * 9/2011 Reuther ..... A41B 11/00 D2/714
8,181,273 B2 * 5/2012 Kane ..... A61F 13/49 2/111
8,959,665 B1 * 2/2015 Garner ..... A41F 9/00 2/236
8,973,168 B2 * 3/2015 Amburgey ..... A41B 11/00 2/227
2003/0014802 A1 * 1/2003 Benham ..... A41D 13/02 2/69

(56) References Cited

U.S. PATENT DOCUMENTS

| | | | | |
|---|---|---|---|---|
| 2003/0093852 | A1* | 5/2003 | Webb | A41F 11/02 2/300 |
| 2004/0216218 | A1* | 11/2004 | McCarthy | A41D 1/08 2/228 |
| 2006/0048262 | A1* | 3/2006 | Sencion | A41D 15/005 2/69 |
| 2006/0137075 | A1* | 6/2006 | Gheneva | A41D 1/06 2/227 |
| 2006/0174399 | A1* | 8/2006 | Nikolayev | A41D 1/06 2/227 |
| 2007/0101475 | A1* | 5/2007 | Skottheim | A41D 13/015 2/69 |
| 2007/0234467 | A1* | 10/2007 | Leach | A41B 11/12 2/227 |
| 2007/0245469 | A1* | 10/2007 | Young | A41D 13/0543 2/458 |
| 2009/0031477 | A1* | 2/2009 | Olmos Plaza | A41D 15/02 2/213 |
| 2011/0067159 | A1* | 3/2011 | Smith | A41D 1/08 2/22 |
| 2011/0179552 | A1* | 7/2011 | Bickley | A41D 1/08 2/227 |
| 2012/0047624 | A1* | 3/2012 | Hubsmith | A41D 15/00 2/125 |
| 2012/0084899 | A1* | 4/2012 | Yanagisawa | A41F 19/00 2/69 |
| 2012/0090076 | A1* | 4/2012 | Kenney | A41D 15/02 2/212 |
| 2012/0260400 | A1* | 10/2012 | Franz | A41D 1/06 2/228 |
| 2014/0123365 | A1* | 5/2014 | Yoo | A41D 15/00 2/74 |
| 2015/0040281 | A1* | 2/2015 | Gbadamosi | A41D 27/201 2/69 |

* cited by examiner

CONVERTIBLE SHORTS/SKIRT/LEGGINGS

CROSS-REFERENCE TO RELATED APPLICATION

This application claims the benefit of U.S. provisional application No. 61/942,747 filed on Feb. 21, 2014, the disclosure of which is incorporated by reference.

FIELD

This invention relates to the field of clothing and more particularly to a system for providing convertible shorts/skirts with detachable leggings.

BACKGROUND

There are many situations in which one needs to convert to and from clothing that covers one's legs. Often, when moving from outdoors where temperatures require leg covering to indoors where temperatures do not require leg covering, perhaps during exercise, a conversion is desired. Many times, one wears shorts for indoor exercise and wears sweat pants over the shorts while traveling outdoors. This is sufficient for warmth, but requires undressing (removing the sweatpants) before exercise. Furthermore, many people prefer leggings over sweatpants for the way leggings shape their legs, provide support, and are conducive to exercising.

In a similar industry, cargo pants have been introduced with removable leg portions, typically attachable/detachable by a zipper that circumnavigates the bottom of the shorts and top of the leg portions at a location approximately mid-thigh. This type of article of clothing is well suited for outdoor exploration, for example, allowing the leg portion to be removed as temperatures increase during daylight hours, but this style does not bode well for exercise, due not only to the appearance, but to the bagginess of the cargo pants style. Furthermore, even though a flap is often provided to cover the zippers, the area at which the leg portion joins with the short portion provides a detraction from the overall style of the article.

There are many times when a person wishes to be stylish, yet quickly transition to workout dress. For example: squeezing in a power-hour workout during a lunch break; heading to the gym after work; heading to yoga after dropping off a child at school then a run on the beach; meeting friends for coffee or lunch before the gym; grocery shopping after a nice walk in the park with grandchildren; running errands after dance, gymnastics, or tennis; etc. All of these often require some sort of dress change.

Further, there are matters of style that individuals prefer, but often, it is difficult to mass-produce large numbers of color variations between sections of clothing. For example, some people prefer a solid color leg portion with a print pattern skirt or shorts while other people prefer a solid color skirt or shorts with a print pattern leggings, while other people prefer everything to be solid and still other people prefer everything to be of a print pattern, To provide all of these options to buyers, manufacturers would need at least four times the number of items for a given style.

What is needed is a system that will detachably join shorts/skirts to leggings without a visible seam to provide robust reconfigurations and multiple color combinations.

SUMMARY

A clothing system having a shorts and/or skirt portion and a legging portion in which the legging portion is removably attached to the shorts and/or skirt portion by fasteners near the waistband of the shorts and/or skirt portion such that, when attached, the upper edge of the legging portion is covered by the shorts and/or skirt portion. In some embodiments, a convertible skirt portion is attached to the shorts portion at the waistband, such that, the skirt portion covers the shorts portion when deployed, or the skirt portion folds up at the waistband appearing like a belt.

In one embodiment, clothing system having removable leggings is disclosed. The removable leggings have two legging portions, each of which has an ankle end and a distal end; the distal end has at least one attachment mechanism. The clothing system includes a shorts portion that has a waistband and at least one mating attachment mechanism for mating with the attachment mechanism of the legging portions. When the legging portions are worn, each is connected to the shorts portion by connecting the attachment mechanisms to respective mating attachment mechanisms resulting in the shorts portion substantially covering and hiding the distal end of each of the legging portions.

In another embodiment, a method of changing clothes is disclosed including donning a shorts portion for covering a central portion of the wearer's body then, at a later time, donning removable leggings. The removable leggings have two legging portions. Each legging portion has an ankle end and a distal end. Donning includes pulling one legging portion over each leg and attaching the distal end to the shorts portion by way of an attachment mechanism. After donning the removable leggings, the shorts portion substantially covers the distal end of the two legging portions.

In another embodiment, a clothing system is disclosed including removable leggings that have two legging portions. Each legging portion has an ankle end and a distal end; the distal end has at least one attachment mechanism and a seam of the distal end has elastic material there within. The clothing system includes a shorts portion that has a waistband and at least one mating attachment mechanism. A skirt portion is affixed to the shorts portion at the waistband. When worn, each of the legging portions is connected to the shorts portion by the attachment mechanisms and respective mating attachment mechanisms in the shorts portion and the shorts portion substantially covers and hides the distal end of each of the legging portions. When the skirt portion is deployed, the skirt portion substantially covers the shorts portion and, when the skirt portion is not deployed, the skirt portion is worn over the waistband to provide the appearance of a belt.

In another embodiment, a clothing system is disclosed including removable leggings that have two legging portions bridged at a first edge distal from an ankle end with at least one strap attached near the first edge. A second end of each of the at least one straps includes a first half of an attachment mechanism. A shorts portion has a waistband and the waistband has a second half of the attachment mechanism. The legging portion is removably attached to the shorts portion by the attachment mechanism and, when worn, the shorts portion substantially covers and hides the first edge of the legging portion.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
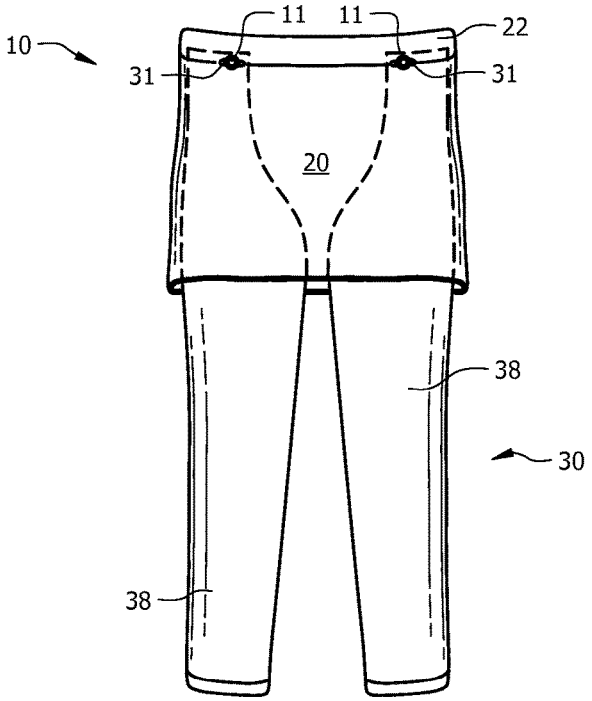
FIG. 1 illustrates a view of a clothing system with removable leggings with the leggings attached and with an optional skirt deployed.

Reference will now be made in detail to the presently preferred embodiments of the invention, examples of which are illustrated in the accompanying drawings. Throughout the following detailed description, the same reference numerals refer to the same elements in all figures.

Note that, throughout this description, the term "removable," although generally an indefinite term, "removable" is limited to being performed by hand without machinery such as one would "remove" their shirt by unbuttoning first. Likewise, the term "affixed" is to be taken as affixed in a way that is not easily removed by hand without machinery as, for example, two sections of cloth that are sewn together are "affixed" as a machine is typically needed to separate the two sections of cloth (e.g., a razor blade or knife). Therefore, one skilled in the art would not view two sections of cloth that are sewn together as being removable.

Throughout this specification, "ankle end" and "ankle area" refer to the lower end of each legging portion 38 and there is no limitation as to how far down the wear's leg that the legging portion 38 reside, in that, the end being referenced is towards the wearer's ankles as opposed to towards the wearer's waist or torso and, therefore, the clothing system 10 is not limited to full-length legging portions 38 that end at the wearer's ankles, as, for example, caprice-style legging portions 38, stirrup-style legging portions 38, and foot-covering legging portions 38 are equally anticipated.

Referring to FIG. 1, a view of a clothing system 10 with removable leggings 30 is shown with the legging portions 38 attached near the waistband 22. The optional skirt portion 20 is shown deployed. In this view, the shorts portion 40 (see FIG. 2) is covered by the optional skirt portion 20, both of which are joined at the waistband 22 by any way of fastening known in the industry, for example, the skirt portion 20 is stitched to the shorts portion 40 at the waistband 22. Note that the skirt portion 20 is optional, in that, in some embodiment, only the shorts portion 40 and removable leggings 30 are provided. Likewise, the shorts portion 40 is also optional, in that, in some embodiment, only the skirt portion 20 and removable leggings 30 are provided.

When present and deployed, the skirt portion 20 covers the shorts portion 40 and provides an aesthetic look that is different than the look of the shorts portion 40 and is often preferred by users before and after exercise. As shown in FIG. 1, each legging portion 38 is attached to the waistband area 22 of the shorts portion 40 by one or more fasteners 11 and mating fasteners 31 such as one or more buttons 11 and button holes 31. In some embodiments, the removable leggings 30 comprise two separate legging portions 38 (as shown). In other embodiments, two legging portions 38 are joined by a bridge area (not shown).

Figure 2:
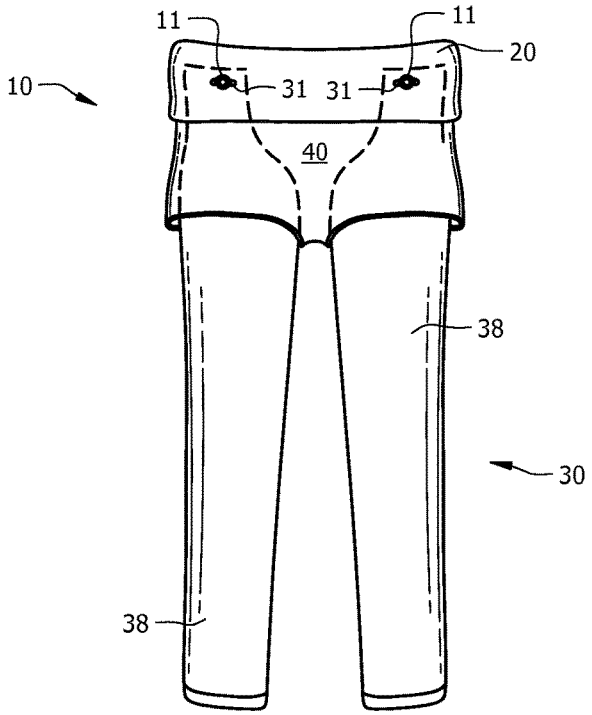
FIG. 2 illustrates a view of the clothing system with removable leggings with the leggings attached and with the optional skirt retracted.

Referring to FIG. 2, a view of the clothing system 10 with removable leggings 30 is shown with the legging portions 38 attached and the optional skirt portion 20 retracted (e.g. rolled up or folded up). In this view, the optional skirt portion 20 has been retracted (e.g. rolled up at the waistband 22) and the shorts portion 40 is exposed. In embodiments in which the skirt portion 20 is provided, the shorts portion 40 and the skirt portion 20 are joined at the waistband 22 (see FIG. 1, covered by skirt portion 20 in FIG. 2) by any way of fastening known in the industry, for example, the skirt portion 20 is fastened to the shorts portion 40 at the waistband 22 by stitching, rivets, adhesive, double-sided tape, etc. Again note that the skirt portion 20 is optional, in that, in some embodiments, only the shorts portion 40 and removable leggings 30 are present. The skirt portion 20 provides a different look than that of only the shorts portion 40 and is often desired by users before and after exercise.

In FIG. 2, the skirt portion 20 is neatly rolled-up at the area of the waistband 22, which is not visible because it is occluded by the skirt portion 20.

Figure 3:
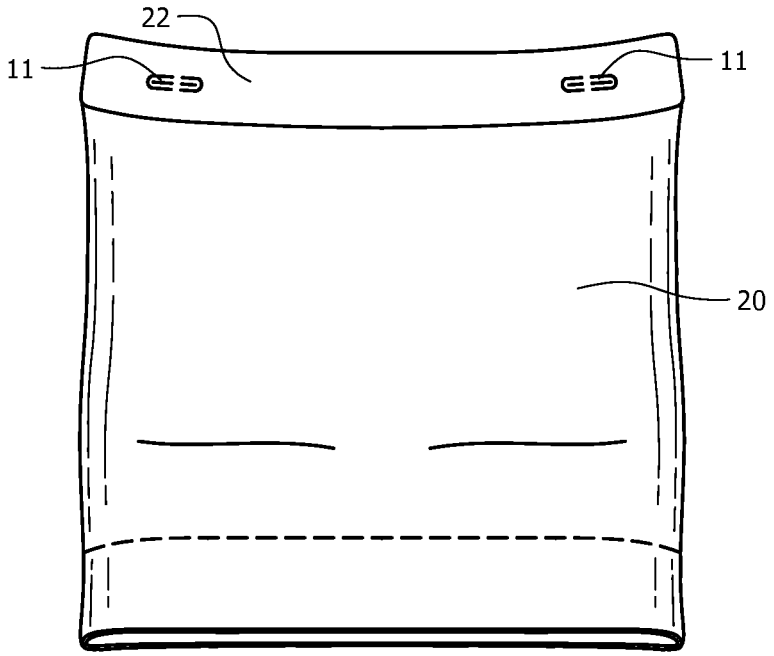
FIG. 3 illustrates a view of the clothing system with removable leggings with the leggings detached and the optional skirt deployed.

Referring to FIG. 3, a view of the clothing system 10 with removable leggings 30 is shown with the legging portions 38 detached (and removed from view) and the optional skirt portion 20 deployed. In this view, the optional skirt portion 20 is deployed. This view includes embodiments in which the optional skirt portion covers the shorts portion 40, or embodiments in which there is only a skirt portion 20 and there is no shorts portion 40. The skirt portion 20 is optional, in that, in some embodiment, only the shorts portion 40 and (when attached) legging portion 38 are present. When present and deployed, the skirt portion 20 provides a different look than the look provided by the shorts portion 40 without the skirt portion 20 and is often used before and after exercise.

Figure 4:
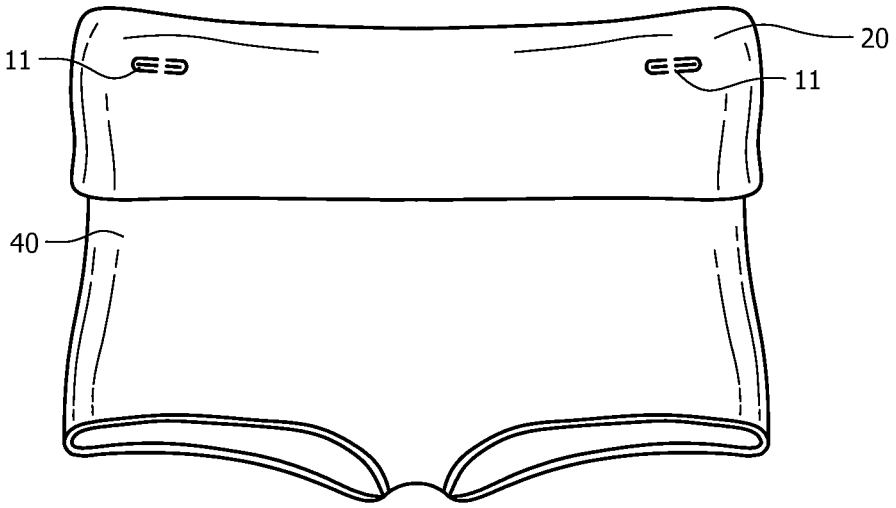
FIG. 4 illustrates a view of the clothing system with removable leggings with the leggings detached and the optional skirt retracted.

Referring to FIG. 4, a view of the clothing system 10 with removable leggings 30 is shown with the legging portions 38 detached (and removed from view) and the optional skirt portion 20 retracted. In this view, the optional skirt portion 20 is retracted (rolled up and covering the area of the waistband 22 which is not visible), exposing the shorts portion 40. Again note that the skirt portion 20 is optional, in that, in some embodiment, only the shorts portion 40 and removable leggings 30 are present. The skirt portion 20 provides a different look than the look provided by the shorts portion 40 without the skirt portion 20 and is often used before and after exercise. As shown, the skirt portion 20 is folded/rolled to cover the waistband 22, providing a different look than embodiments in which the skirt portion 20 is not present and only the shorts portion 40 is present.

Figure 5:
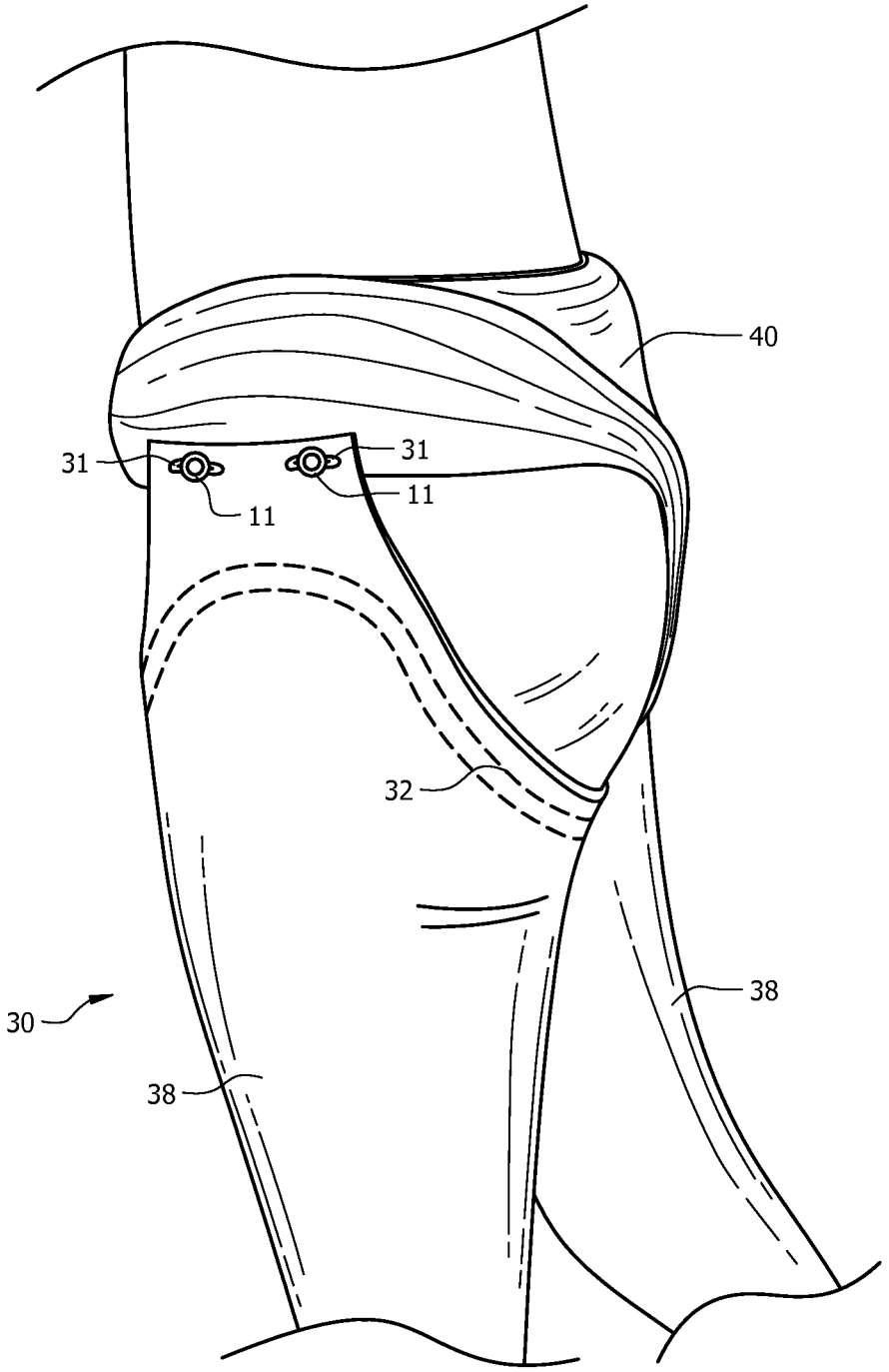
FIG. 5 illustrates a first view of the clothing system with removable leggings showing the removable leggings attachment system.
Figure 6:
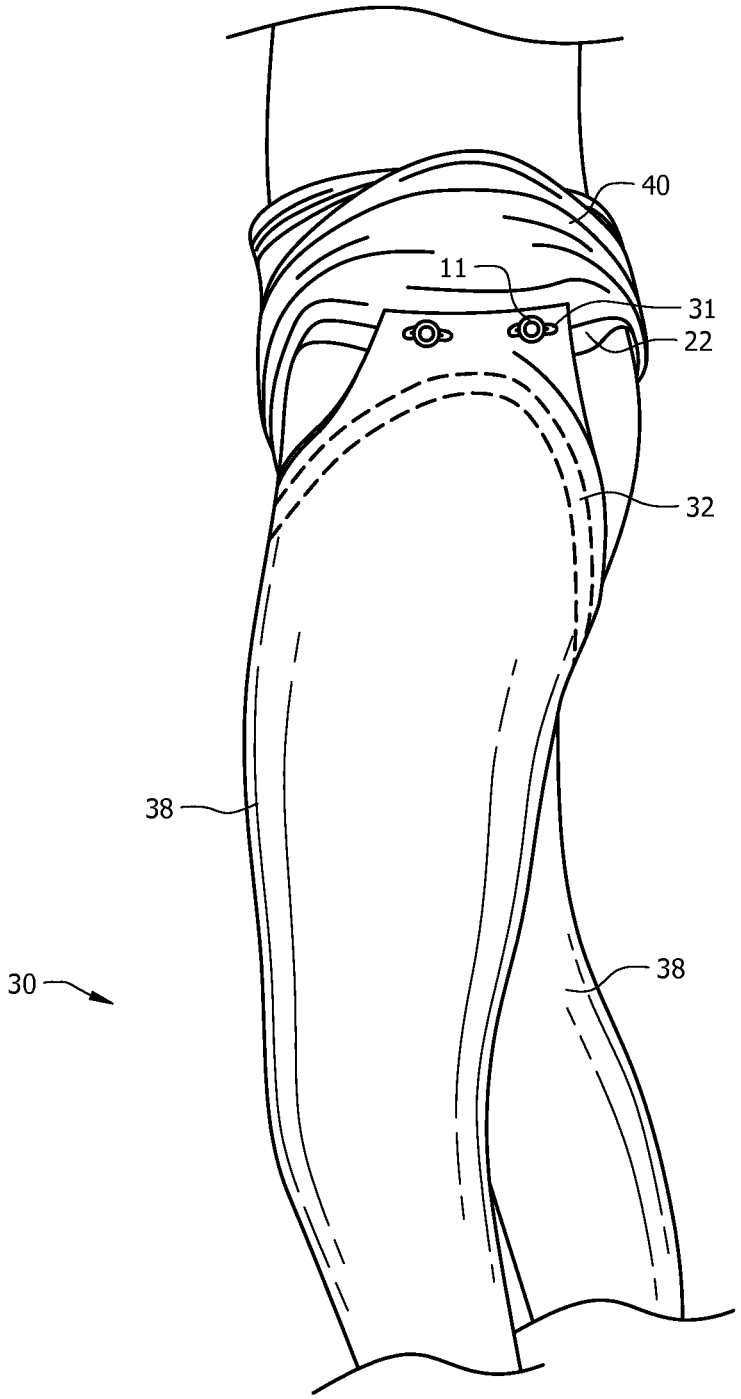
FIG. 6 illustrates a second view of the clothing system with removable leggings showing the removable leggings attachment system.
Figure 7:
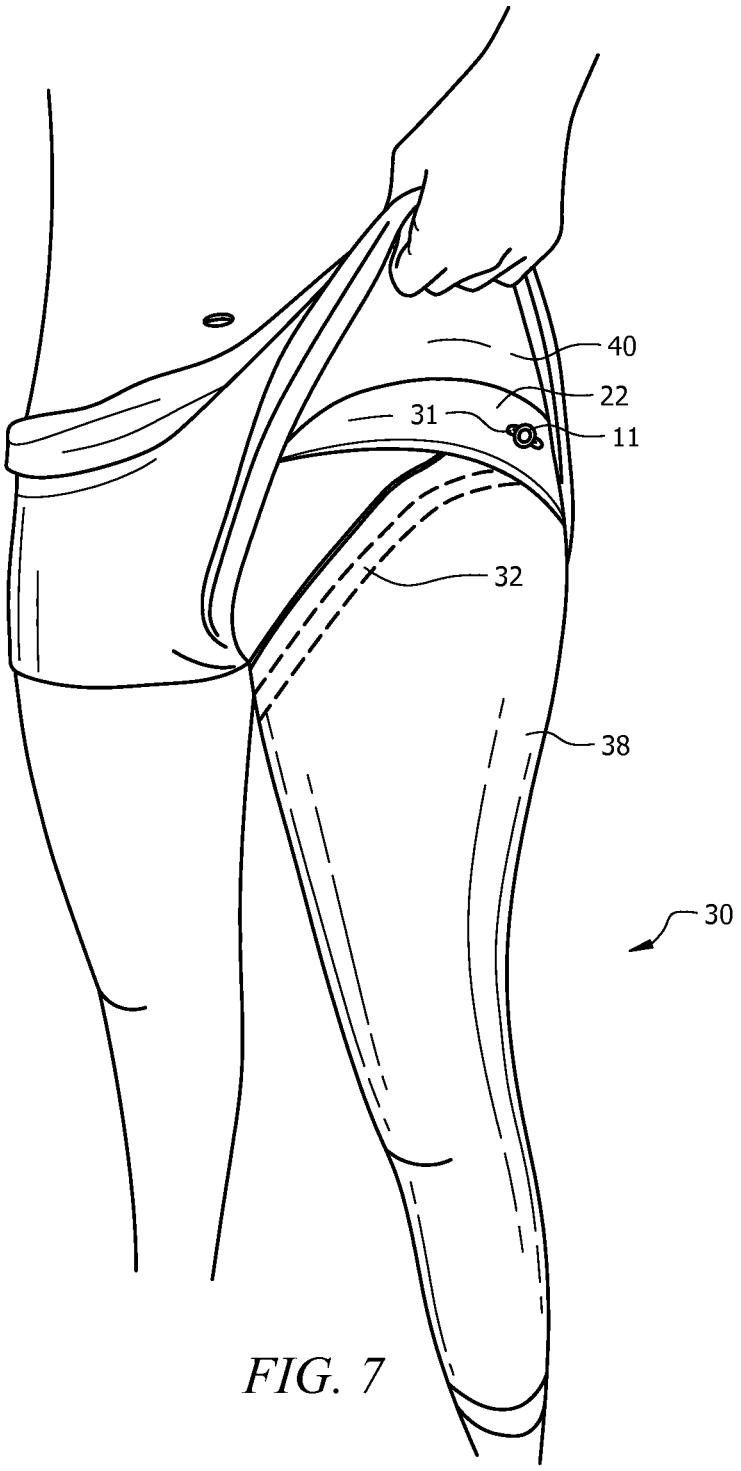
FIG. 7 illustrates a third view of the clothing system with removable leggings showing the removable leggings attachment system.

Referring to FIGS. 5 through 7, views of the clothing system 10 with removable leggings 30 is shown with the removable leggings 30 attached. When attached, each of the legging portions 38 is removably interfaced to the shorts portion 40 in the area of the waistband 22 by a series of fasteners 11 and mating fasteners 31. For example, in some embodiments the fasteners are buttons 11, the mating fasteners 31 are button holes 31. In other embodiments the fasteners 11 are hook material, the mating fasteners 31 are loop material. In other embodiments the fasteners 11 are snaps 11, the mating fasteners 31 are snap receivers 31. Again, any type of fastener 11 and mating fastener 31 is anticipated and there is no limitation as to which portion 20/40/38 has which side of the fastener 11/31 (e.g., it is equally anticipated that the buttons 11 be on the legging portions 38 and the button holes be on the skirt portion 20 and/or the shorts portion 40). Additionally, any number of pairs of fasteners 11/31 is anticipated, including one pair of fasteners 11/31 for each legging portion 38.

Figure 8:
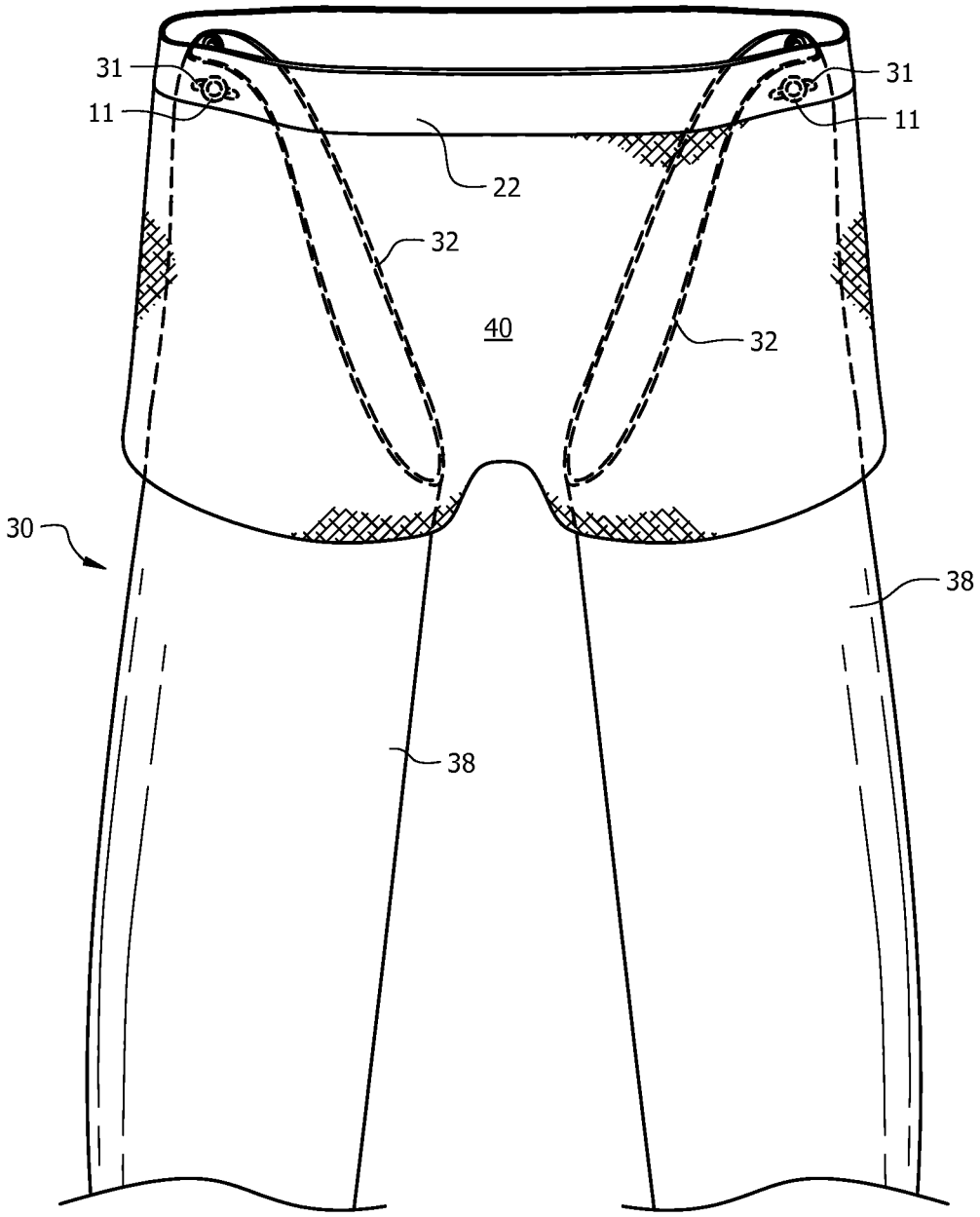
FIG. 8 illustrates a cut-away view of the clothing system with removable leggings showing a shorts portion with the removable leggings attached.

Referring to FIG. 8, a cut-away view of an exemplary clothing system 10 with removable leggings 30 showing the removable leggings attachment system is shown. In this example, there are fasteners 11 in the area of the waistband 22 of the shorts portion 40. There are mating fasteners 31 along the upper edge area of each legging portion 38. To attach the legging portions 38 to the shorts portion 40, the fasteners 11 in the area of the waistband 22 of the shorts portion 40 are engaged with (e.g. buttoned) mating fasteners 31 along the upper edge of each legging portion 38. To remove the legging portions 38 from the shorts portion 40, the fasteners 11 in the area of the waistband 22 of the shorts portion 40 are disengaged (e.g. unbuttoned) from mating fasteners 31 along the upper edge of each legging portion 38.

In some embodiments, a cover material or flap is provided over the fastener 11 and/or mating fastener 31 for added comfort.

In some embodiments, the legging portions 38 are independent of each other. In other embodiments the legging portions 38 are interfaced to each other by a crotch/bridge section.

As shown, the upper edges 32 of the legging portions 38 (distal from the ankle area 39 of the legging portions 38) are completely covered by the shorts portion 40, thereby substantially hiding the top edge 32 of each of the legging portion 38 and providing an overall look in which it appears that the removable leggings 30 is a continuous part of the shorts portion 40, especially when both are made from the same material and pattern, though such is not required.

Although it is anticipated that in some embodiments, the removable leggings 30 are connected by a bridge (not shown), in other embodiments, the legging portions 38 are separate, providing even more configuration options, in that, in one scenario, the user wears a shorts portion 40 that is made from the same material (e.g. material composition, texture, pattern, color) as both legging portions 38, while in another scenario the user wears a shorts portion 40 that is made from the a different material (e.g. material composition, texture, pattern, color) as both of the legging portions 38, while in still another scenario, the user wears a shorts portion 40 that is made from a different material (e.g. material composition, texture, pattern, color) as one of the legging portions 38 and the other legging portion 38 is made from another, different material (e.g. material composition, texture, pattern, color). Further, since legging portions 38 tend to wear faster than shorts portions 40, the above state flexibility provides the ability to market the clothing system 10 with spare legging portions 38 and/or mix-and-match legging portions 38.

Figure 9:
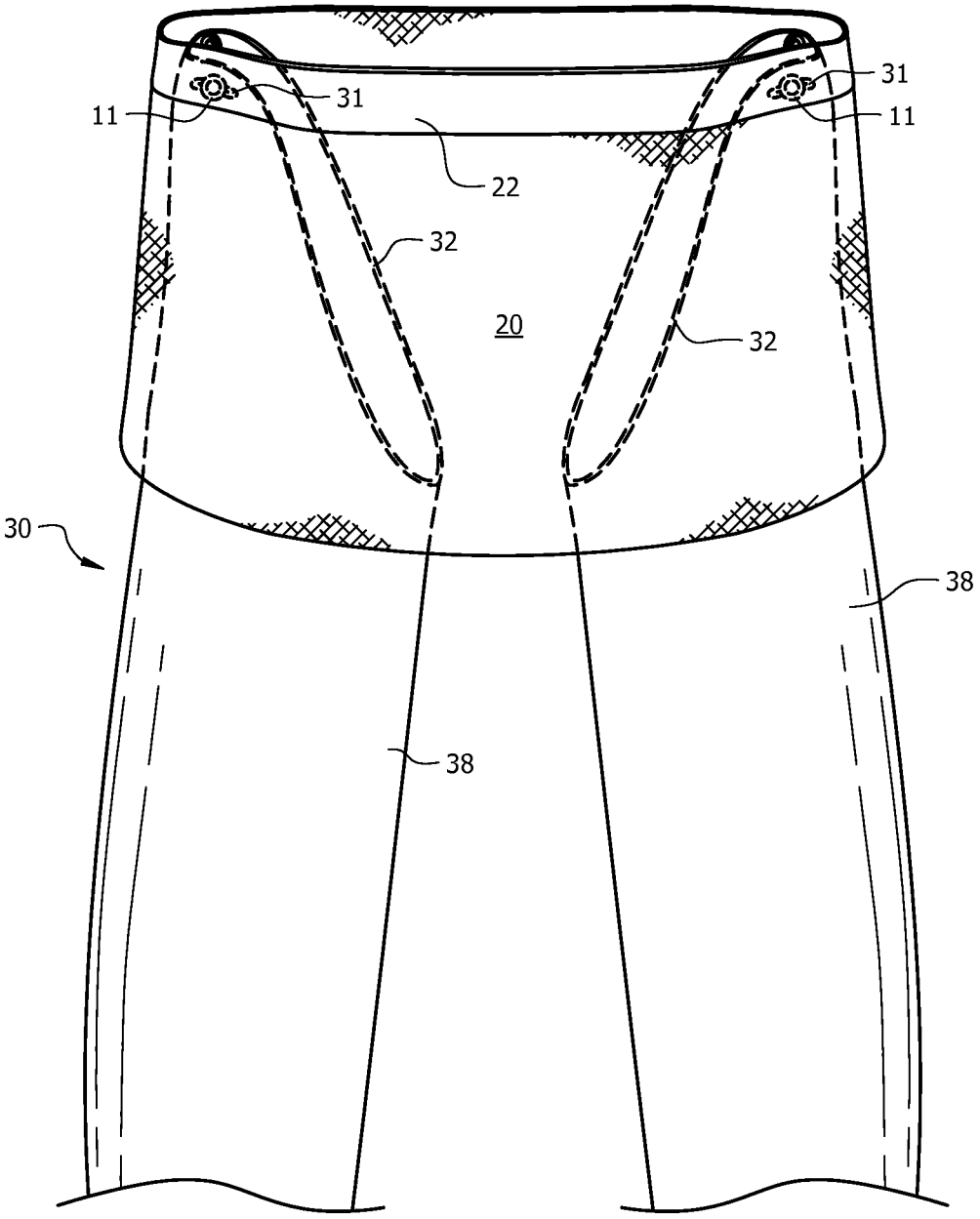
FIG. 9 illustrates a cut-away view of the clothing system with removable leggings showing a skirt portion with the removable leggings attached.

Referring to FIG. 9, a cut-away view of an exemplary clothing system 10 with removable leggings 30 showing the removable leggings attachment system is shown. In this example, there are fasteners 11 in the area of the waistband 22 of the skirt portion 20. There are mating fasteners 31 along the upper edge area of each legging portion 38. To attach the legging portions 38 to the skirt portion 20, the fasteners 11 in the area of the waistband 22 of the skirt portion 20 are engaged with (e.g. buttoned) mating fasteners 31 along the upper edge of each legging portion 38. To remove the legging portions 38 from the skirt portion 20, the fasteners 11 in the area of the waistband 22 of the skirt portion 20 are disengaged (e.g. unbuttoned) from mating fasteners 31 along the upper edge of each legging portion 38.

In some embodiments, a cover material or flap is provided over the fastener 11 and/or mating fastener 31 for added comfort.

In some embodiments, the legging portions 38 are independent of each other. In other embodiments the legging portions 38 are interfaced to each other by a crotch/bridge section.

As shown, the upper edges 32 of the legging portions 38 are completely covered by the skirt portion 20, thereby hiding the upper edges 32 of each of the legging portions 38 and providing an overall look in which it appears that the removable leggings 30 is a continuous part of the skirt portion 20, especially when both are made from the same material and pattern, though such is not required.

Although it is anticipated that in some embodiments, the removable leggings 30 are connected by a bridge (not shown), in other embodiments, the legging portions 38 are separate, providing even more configuration options, in that, in one scenario, the user wears a skirt portion 20 that is made from the same material, pattern, and color as both legging portions 38, while in another scenario the user wears a skirt portion 20 that is made from the a different material, pattern, and color as both of the legging portions 38, while in still another scenario, the user wears a skirt portion 20 that is made from a different material, pattern, and color as one of the legging portions 38 and the other legging portion 38 is made from still another, different material, pattern, and color. Further, since the legging portions 38 tend to wear faster than skirt portion 20, the above state flexibility provides the ability to market the clothing system 10 with spare legging portions 38 and/or mix-and-match legging portions 38.

Figure 10:
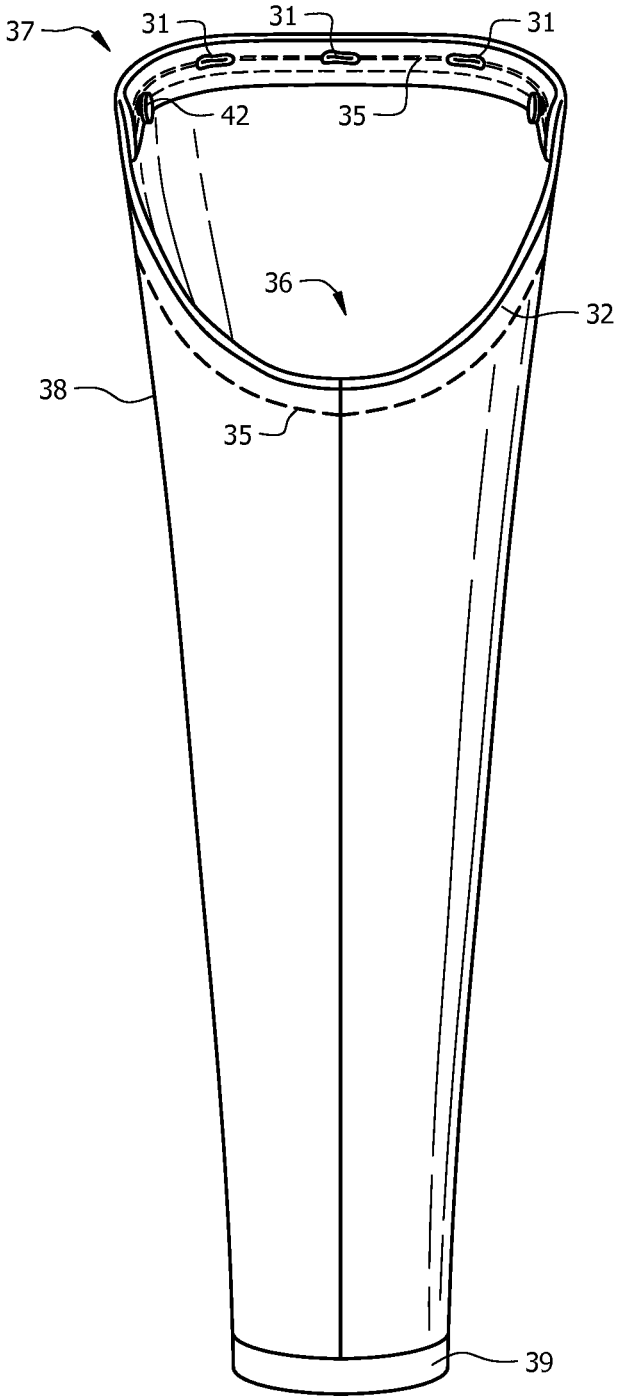
FIG. 10 illustrates a perspective view of a single legging portion of the clothing system with removable leggings.

Referring to FIG. 10, a perspective view of a single legging portion 38 of the clothing system 10 with removable leggings 30 is shown. Each legging portion 38 is generally tubular in shape when worn, conforming to the shape of a wearer's leg, either form-fit, loose-fit, baggy, bell-bottom, etc. Although any ankle area termination is anticipated, a simple seam 39 is shown.

The upper area of the legging portion 38 (waist area to thigh area) is shown as having a somewhat level area 37 and a crotch area 36. The level area 37, when worn, conforms and abuts the area of the waistband 22 of the shorts portion 40, the skirt portion 20, or both (when combined). The crotch area 36 conforms to the crotch area of the wearer without overly applying pressure in that area.

The level area 37 of the legging portion 38 has one or more matting fasteners 31 that, when worn, mate with fasteners 11 of the shorts portion 40, the skirt portion 20, or both (when combined). By attaching the fasteners 11 to the mating fasteners 31, the legging portions 38 become part of the ensemble and, from the outside of the skirt portion 20 or shorts portion 40; appear to be a single article of clothing.

Although not required, it is preferred to include an elastic material 35 within the seam of the upper edges 32. When present, the elastic material 35 provides an improved fit, maintains the position of the legging portions 38 while donning or removing, and maintain the shape of the upper edges 32 after repeated wear.

Figure 11:
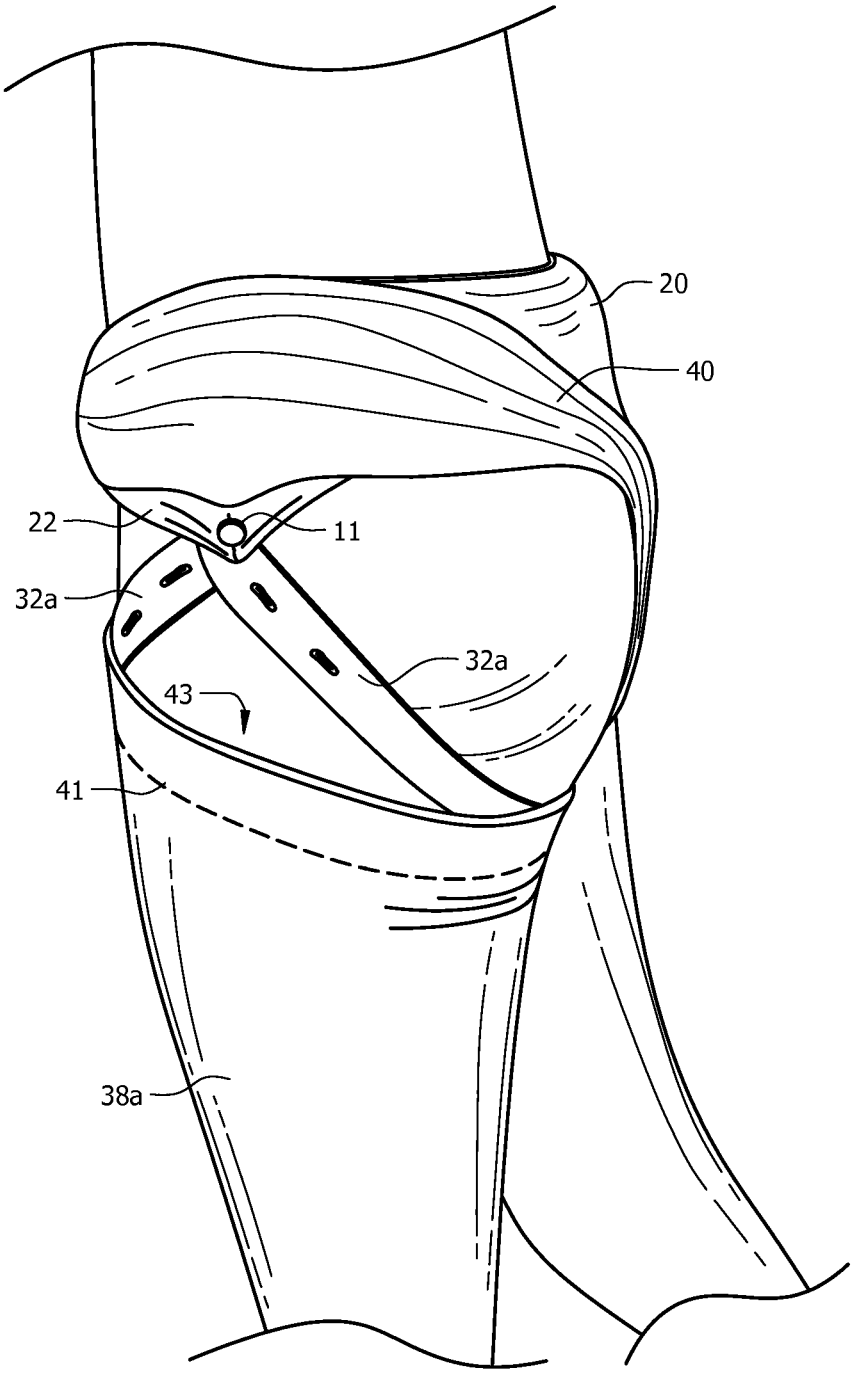
FIG. 11 illustrates a first view of the clothing system with removable leggings showing the removable leggings attachment system with an alternate legging portion.
Figure 12:
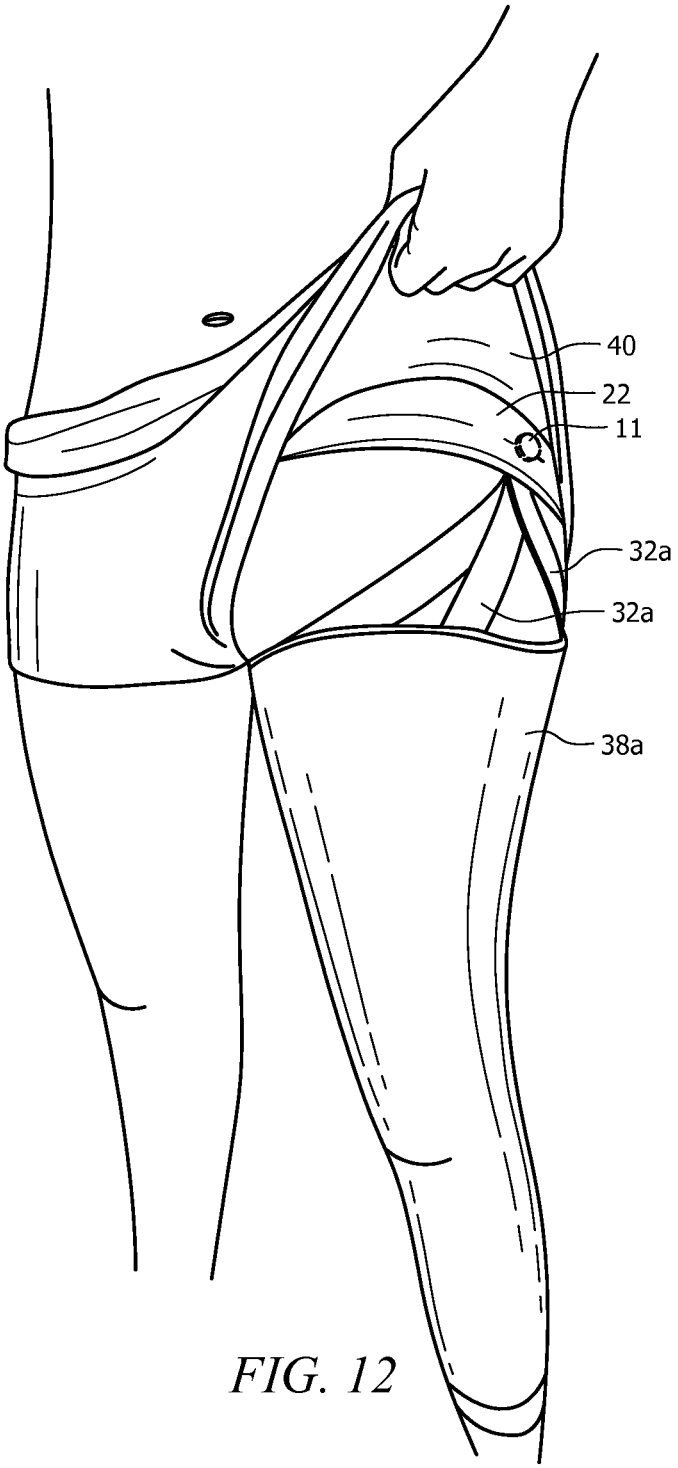
FIG. 12 illustrates a second view of the clothing system with removable leggings showing the removable leggings attachment system with an alternate legging portion.

Referring to FIGS. 11 and 12 views of the clothing system are shown with removable leggings 10 showing the removable leggings attachment system with an alternate legging portion 38A. The alternate legging portion 38A is generally tubular in shape when worn, conforming to the shape of a wearer's leg, either form-fit, loose-fit, baggy, bell-bottom, etc. The upper area 43 of the alternate legging portions 38A are generally linear (e.g., there is no dip or crotch area 36).

The upper area 43 of the alternate legging portions 38A has straps 32A, preferable multiple straps 32A on each of the alternate legging portion 38A. In the example shown, a first end of each of the straps 32A is affixed to an upper edge of the alternate legging portion 38A by any attachment mechanism known in the art such as stitching, adhesives, etc. A second end of the straps 32A is removably attached to the waistband 22 by any detachable and re-attachable mechanism known in the industry such as a button 11/button-hole 31 (as shown), a snap fastener, a hook fastener, hook-and-loop fasteners, magnets, etc. The detachable and re-attachable mechanism is shown as buttons 11 on the waistband 11 and button holes 31 on the straps 32A. In some embodiments, small cloth covers (not shown) are provided to cover the buttons 11 for added comfort. In some embodiments, the second ends of the straps 32A are affixed to each other at the location of the fasteners 11/31.

In some embodiments the alternate legging portions 38A are interfaced to each other by a crotch/bridge section.

Although any material is anticipated for fabrication of the straps 32A, the straps 32A are preferably made of a resilient material (elastic, resilient cloth, etc.). By making the straps from a resilient material, tension is applied to the removable alternate legging portions 38A, providing support to the wearer's upper legs in the hamstring area, improving the wearer's appearance as well as adding extra support for the lumbar. Resilient straps 32A further provide some level of resistance when the wearer stretches, improving exercise and helping to stabilize balancing postures such as dancer's pose or extended hand to big toe pose.

Although a triangular-like formation of straps 32A are shown in FIGS. 11 and 12, there is no limitation on the exact location of attachment of the straps 32A to either the alternate legging portions 38A to the shorts portion 40 or skirt portion 20 in the area of the waistband 22. In some embodiments as shown in FIGS. 11 and 12, multiple straps 32A join together and a single attachment strap 32A (made of the same or different material) holds the detachable and re-attachable mechanisms (e.g. button hole and button) for engaging with the shorts portion 40 or skirt portion 20 in the area of the waistband 22.

Note, it is anticipated that when the straps 32A are attached to the shorts portion 40 or skirt portion 20 in the area of the waistband 22, the top edge of the alternate legging portions 38A as well as the straps 32A are completely covered by the skirt portion 20 and/or the shorts portion 40 as shown on one side of FIG. 12 where the shorts portion 40 is not being pulled up by a hand.

Again, any combination of material, color, and patterns is anticipated for the shorts portion 40, the skirt portion 20, and the alternate legging portion 38A, providing flexibility to the wearer and the marketer. It is anticipated that the shorts portion 40, the skirt portion 20, and the alternate legging portion 38A be sold as sets or as separate components.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A clothing system comprising:

removable leggings, the removable leggings having two legging portions, each legging portion having an ankle end and a distal end, the distal end having at least one attachment mechanism, wherein each legging portion includes a first resilient material that extends completely around a circumference of the legging portion adjacent to the distal end, wherein the first resilient material does not include the at least one attachment mechanism, wherein the first resilient material does not form the distal end, wherein the first resilient material is configured to allow each legging portion to form-fit around a leg of a wearer from an ankle of the wearer to at least a thigh of the wearer, and wherein the distal end includes a second resilient material that is configured to maintain a shape of the distal end after repeated wearing and removing of the legging portions;

a shorts portion having a waistband, the shorts portion having at least one mating attachment mechanism on an inner side of the waistband, wherein the shorts portion has no mating attachment mechanism on an outer side of the waistband, and wherein the shorts portion is configured to extend from a waist of the wearer to the thigh of the wearer;

a skirt portion having a first end permanently stitched to the waistband and a second end not attached to the shorts portion, the skirt portion having a deployed state and a retracted state, wherein the skirt portion is placed in the retracted state by pulling the second end upwards above the waistband, wherein the skirt portion is placed in the deployed state by pulling the second end downwards below the waistband, wherein the skirt portion substantially covers the shorts portion when the skirt portion is placed in the deployed state, wherein the skirt portion is not visible in the retracted state, wherein the skirt portion is not removable from the waistband, and wherein the skirt portion is made from a first material, and the shorts portion is made from a second material different from the first material;

wherein when worn, each of the legging portions are connected to the shorts portion by connecting each attachment mechanism to a respective mating attachment mechanism on the waistband, and the shorts portion substantially covers and hides the distal end of each of the legging portions when the legging portions are connected to the shorts portion, wherein the first resilient material is configured to provide a first tension around a circumference of the leg of the wearer, and the second resilient material is configured to provide a second tension to a hamstring area of the wearer, wherein the first tension is different than the second tension, and wherein the shorts portion and the legging portions are configured to appear as a single outfit when the legging portions are connected to the shorts portion;

wherein the removable leggings are disconnected from the shorts portion when the skirt portion is in the deployed state, and wherein the removable leggings are not connected to the shorts portion when the skirt portion is in the deployed state;

wherein each of the attachment mechanisms is a hook-and-loop-fastener;

wherein the first resilient material is made from a first elastic material, and the second resilient material is made from a second elastic material;

wherein the distal end of each legging portion has a level area and a crotch area, wherein a first distance from the ankle end of the legging portion to the crotch area of the legging portion is less than a second distance from the ankle end of the legging portion to the level area of the legging portion, and wherein the crotch area is configured to conform to a crotch of the wearer without overly applying pressure to the crotch of the wearer, and without substantially covering the crotch of the wearer; and wherein the shorts portion and each of the legging portions are made from the second material, wherein the second material has a different fabric, texture, color, or pattern than the first material.

* * * * *